US006994579B2

(12) United States Patent
Yokoigawa et al.

(10) Patent No.: US 6,994,579 B2
(45) Date of Patent: Feb. 7, 2006

(54) CONNECTOR

(75) Inventors: Atsushi Yokoigawa, Yokohama (JP); Hisakazu Yamada, Otsu (JP); Makoto Sato, Okayama (JP); Masayuki Okamoto, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/111,059

(22) Filed: Apr. 21, 2005

(65) Prior Publication Data

US 2005/0239311 A1 Oct. 27, 2005

(30) Foreign Application Priority Data

Apr. 23, 2004 (JP) ..... 2004-128163

(51) Int. Cl.
*H01R 13/62* (2006.01)

(52) U.S. Cl. ..... 439/320; 439/311; 439/314

(58) Field of Classification Search ..... 439/310–314, 439/320

See application file for complete search history.

(56) References Cited

U.S. PATENT DOCUMENTS 3,136,592 A * 6/1964 Miller ..... 439/314
4,310,213 A * 1/1982 Fetterolf et al. ..... 439/320
4,440,464 A 4/1984 Spinner
2005/0118853 A1 * 6/2005 Starke et al. ..... 439/320

FOREIGN PATENT DOCUMENTS

JP 2001-052821 2/2001
JP 2002-237348 8/2002

OTHER PUBLICATIONS

European Search Report for European Application No. EP 05 10 2990 dated Jul. 4, 2005, 4 pages.
Patent Abstracts of Japan, Publication No. 2002-237348 dated Aug. 23, 2002, 1 page.
Patent Abstracts of Japan, Publication No. 2001-052821 dated Feb. 23, 2001, 1 page.

* cited by examiner

*Primary Examiner*—Tho D. Ta
(74) *Attorney, Agent, or Firm*—Osha Liang LLP

(57) ABSTRACT

A plug includes a plug main body, a connection sleeve, and a connection ring. A socket includes a socket main body and a socket holder. An insertion member of the socket main body is fitted to an engagement concave of the plug main body. An engaging projection of the socket holder is fitted to one end of a circular-arc slit of the connection ring. The connection ring is rotated to relatively shift the engaging projection along the circular-arc slit, and the engaging projection is positioned and locked at the other end of the circular-arc slit.

10 Claims, 12 Drawing Sheets

CONNECTOR

BACKGROUND OF THE INVENTION

1. Field of the Invention

The present invention relates to a connector, and more particularly to a connector capable of functioning as both a screw connector and a bayonet connector.

2. Background Art

As a conventional connector, a screw connector for making coaxial and electrical connection with electric cables via a screw is used, for example (see JP-A-2002-237348). In the screw connector, a socket or a plug needs to be rotated several times for connection of both. This method of connection requires time and labor and thus lowers work efficiency. Also, predetermined fastening torque is always needed to secure predetermined waterproof properties or reliability of the electric connection. In the screw connector, however, there is a possibility of loosening of the connector due to slight vibration and the like applied thereto. Thus, the torque has to be kept controlled and thus complicated maintenance for the screw connector is needed.

As a connector which overcomes the above problems, a so-called bayonet connector (see JP-A-2001-52821) has been developed, for example. However, since the bayonet connector cannot be coupled to the screw connector, all plugs and sockets of the screw connectors need to be replaced with those of the bayonet connectors when it is desired to increase work efficiency of connection and attain easy maintenance, which causes many losses.

SUMMARY OF THE INVENTION

Wherefore, it is an object of the invention to provide a connector which can be connected with a conventional screw connector with increased work efficiency of connection and requires only easy maintenance.

In order to achieve the above object, a connector provided according to the invention is a connector for coaxially connecting connection lines by connecting a plug one end of which connects with one of the connection lines and a socket one end of which connects with the other of the connection lines as one piece. The plug includes: (a) a plug main body one end of which connects with the connection line and the other end of which has an engagement concave; (b) a connection sleeve as a cylindrical component rotatably attached to the outer surface of the plug main body with separation prevented, a guide member being provided on the outer surface at one end of the connection sleeve, and a male screw being formed on the outer surface at the other end of the connection sleeve; and (c) a connection ring as a cylindrical component on the outer surface of which a circular-arc slit is formed, the connection ring coaxially accommodating the connection sleeve with separation prevented, and the connection ring being assembled to the connection sleeve to be rotatable with the connection sleeve as one piece. The socket includes: (a) a socket main body one end of which connects with the connection line and the other end of which has a projecting insertion member; and (b) a socket holder as a cylindrical component which coaxially accommodates the socket main body with separation prevented, an engaging projection being provided on the outer surface of the socket holder close to the opening edge thereof, a guide member being provided on the inner surface of the socket holder opposed to the socket main body close to the opening edge of the socket holder, and a female screw being formed at the back of the guide member. The insertion member of the socket main body is fitted to the engagement concave of the plug main body. The engaging projection of the socket holder is fitted to one end of the circular-arc slit of the connection ring. The engaging projection is relatively shifted along the circular-arc slit to be positioned and locked at the other end of the circular-arc slit.

In the socket, the socket holder may be rotatably attached to the socket main body. The connection sleeve and the connection ring may be formed integrally with each other.

According to the invention, when the engaging projection in engagement with one end of the circular-act slit is relatively shifted along the circular-arc slit and then positioned and locked at the other end of the circular-arc slit, the insertion member of the socket main body is pressed into the engagement concave of the plug main body to connect the socket and the plug as one piece. Thus, the plug and the socket can be coupled into one piece by one action, thereby providing a connector which has high work efficiency of connection and requires only easy maintenance.

An example of the connector according to the invention may include a screw socket having a socket holder as a cylindrical component which coaxially accommodates a socket main body with separation prevented and on the inner surface of which a female screw is formed opposed to the socket main body. In this structure, an insertion member of the socket main body is fitted to the engagement concave of the plug main body, and the female screw of the screw socket is fitted to the male screw of the connection sleeve so as to connect the screw socket to the plug as one piece.

Another example of the connector according to the invention may include a screw plug having a plug holder as a cylindrical component which is rotatably attached to the outer surface of a plug main body with separation prevented and on the outer surface of which a male screw is formed at the tip of the plug holder. In this structure, the insertion member of the socket main body is fitted to an engagement concave of the plug main body, and the male screw of the screw plug is fitted to the female screw of the socket holder so as to connect the screw plug to the socket as one piece.

In the above-described examples, since each of the plug and the socket included in the connector of the invention has the guide member close to the opening edge, the conventional screw socket holder and plug holder can be coaxially coupled to the plug and socket of the invention as one piece. Since connection into one piece can be made without requiring replacement of the conventional screw connectors, the connector having high usability and causing no loss can be provided according to the invention.

Still another example of the connector according to the invention may include electric cables as the connection lines. In this example, electric connection can be made by one action. Thus, the connector having high work efficiency of connection and requiring only easy maintenance can be provided according to the invention.

DESCRIPTION OF THE PREFERRED EMBODIMENTS

Preferred embodiments of a connecting structure according to the invention are hereinafter described with reference to FIGS. 1 through 12.

As illustrated in FIGS. 1, 2, 9 and 10, a connector in a first embodiment includes a bayonet plug 10 and a bayonet socket 40 to be used for electrical connection.

Figure 1A:
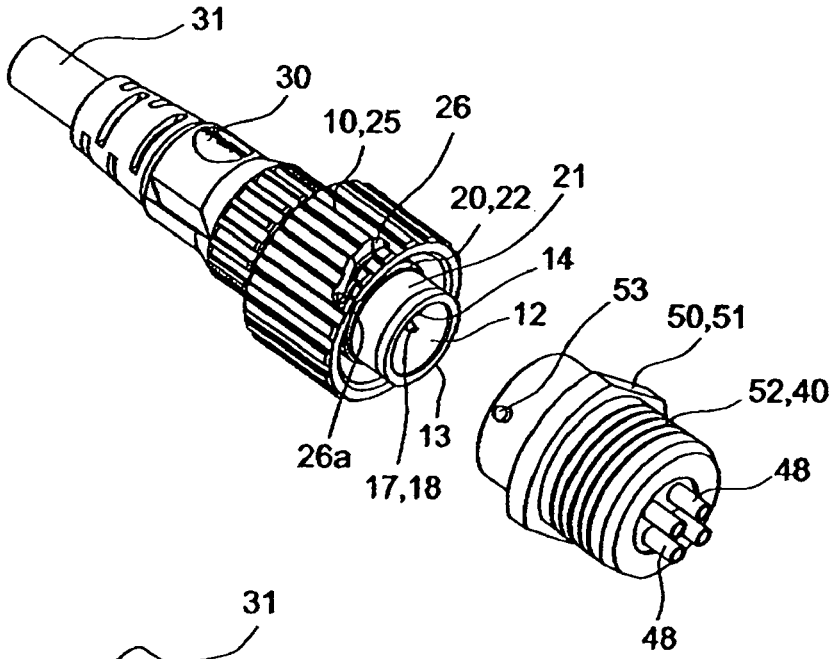
FIGS. 1A, 1B and 1C are perspective views of a connector before connection, during connection and after connection, respectively, in a first embodiment according to the invention.
Figure 1B:
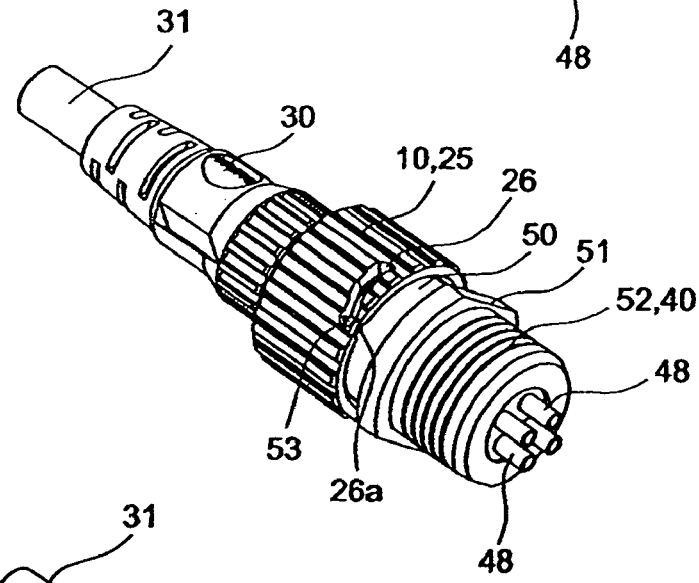
Figure 1C:
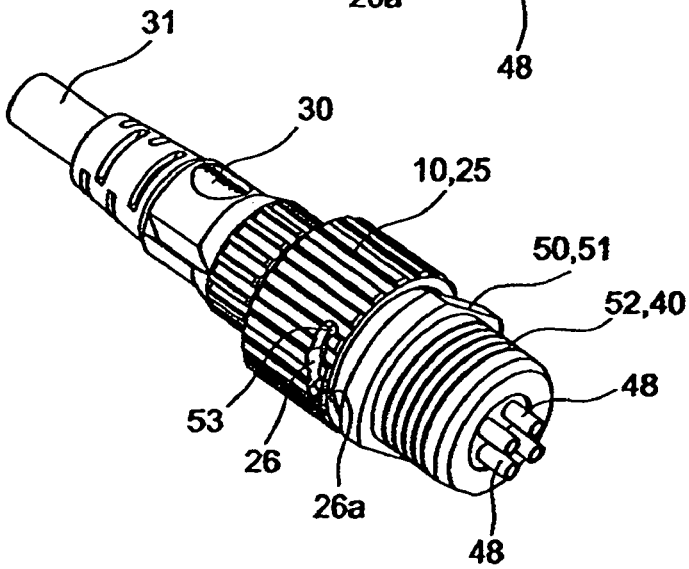
Figure 2A:
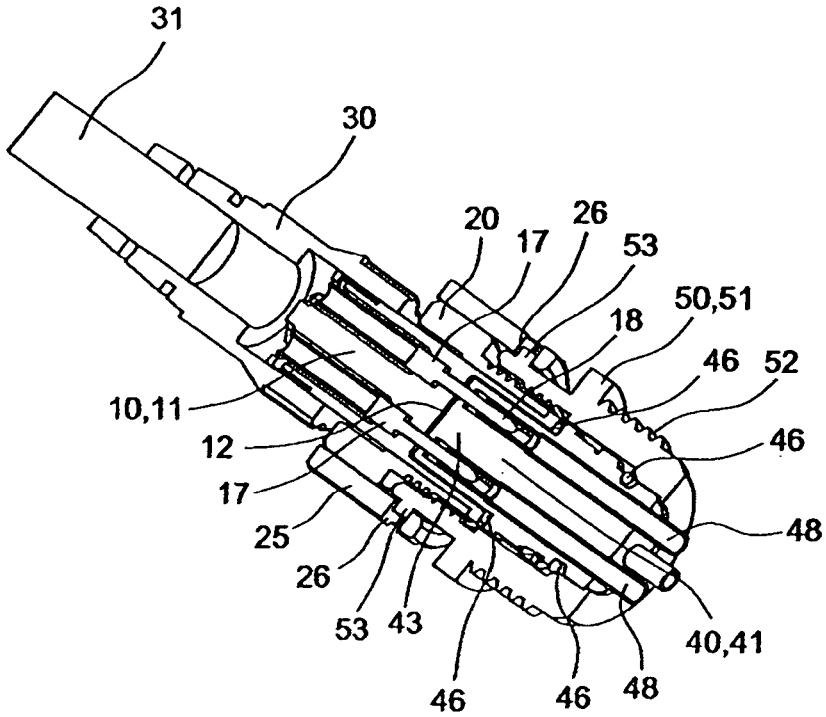
FIGS. 2A and 2B are a cross-sectional view and a cross-sectional front view of FIG. 1C, respectively.
Figure 2B:
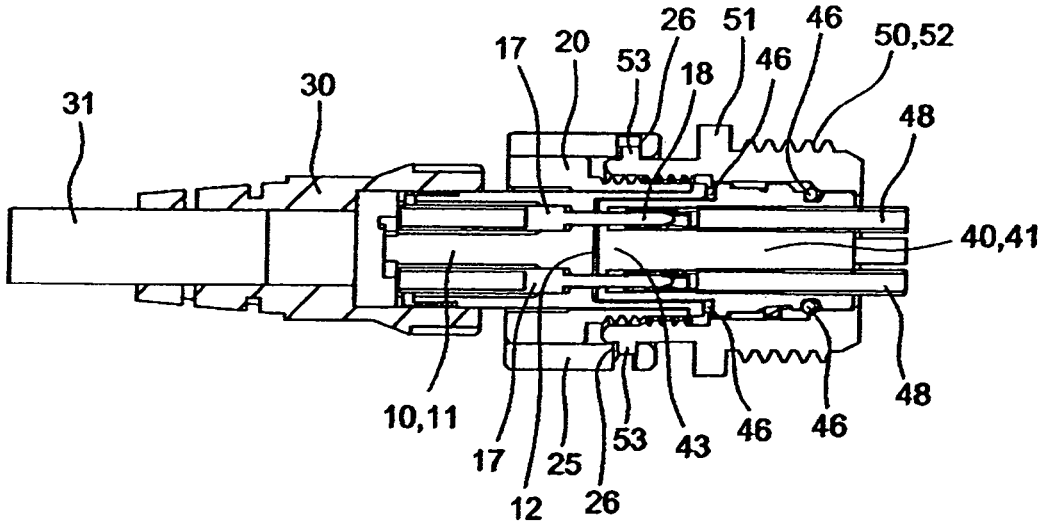
Figure 9A:
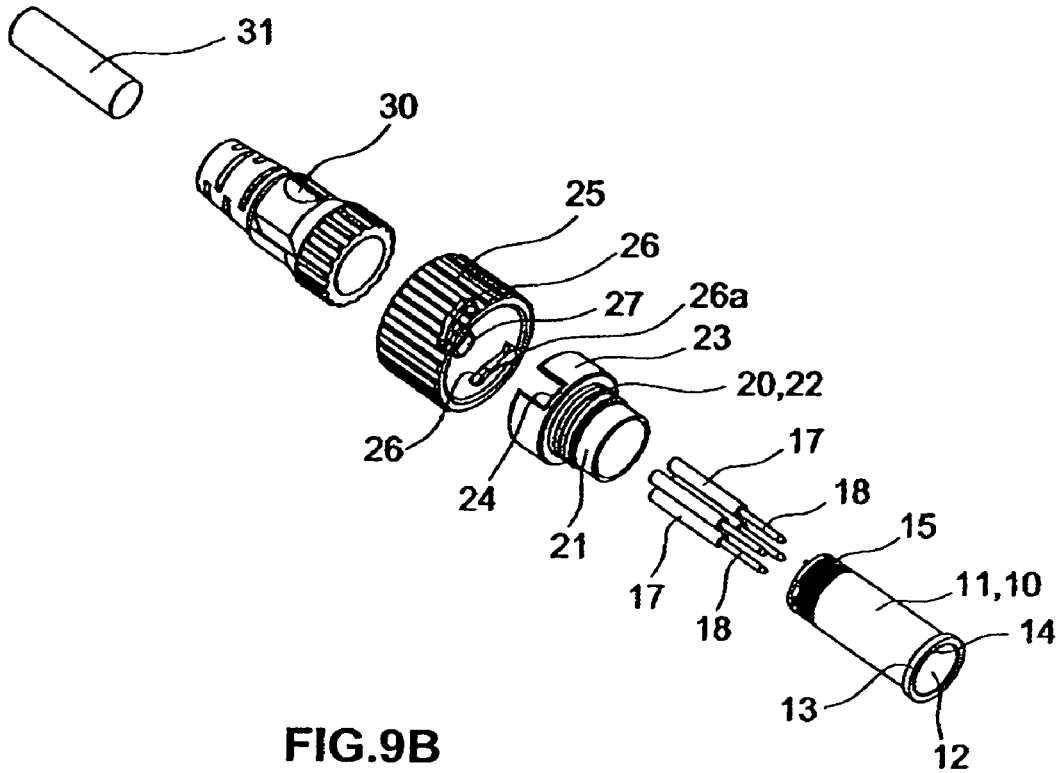
FIGS. 9A and 9B are perspective views of a disassembled bayonet plug in the first embodiment as viewed at different angles.
Figure 9B:
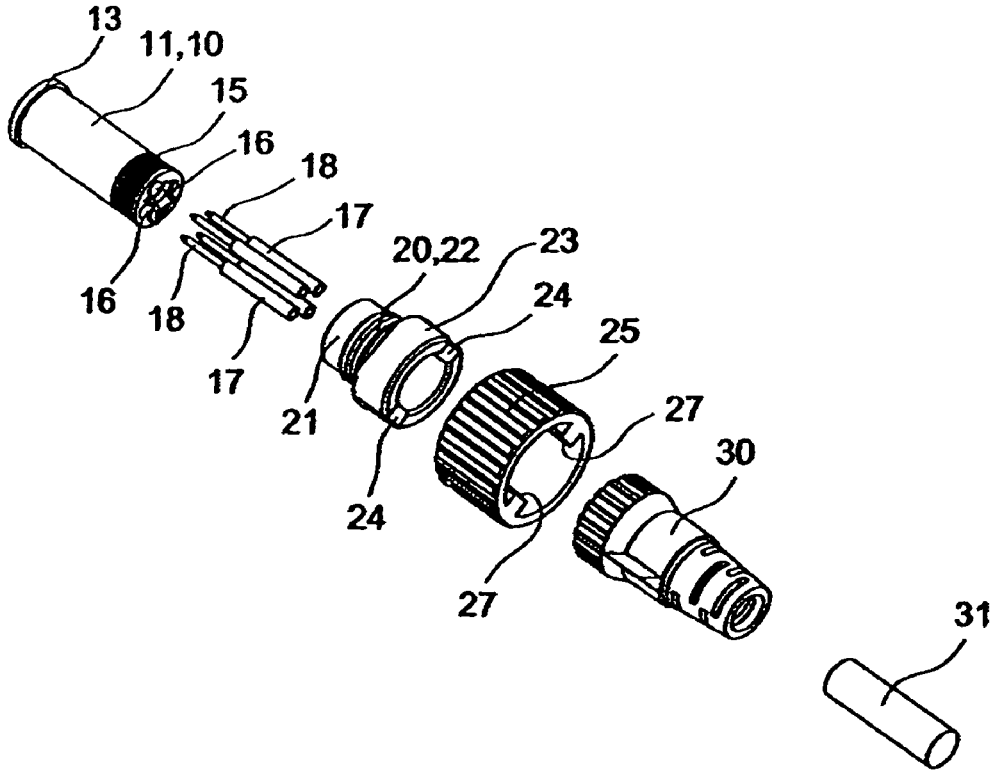

As illustrated in FIGS. 1, 2 and 9, the bayonet plug 10 has a plug main body 11, four pin terminals 17, a connection sleeve 20, a connection ring 25, an outside cover 30, and an electric cable 31.

The plug main body 11 is a cylindrical component made from resin. An annular rib 13 for preventing separation is provided on an opening edge of an engagement concave 12 formed at one end of the plug main body 11. A guiding projection 14 is provided on the inside surface of the engagement concave 12 in the direction of the axial center. Four terminal holes 16 which communicate with the engagement concave 12 are provided at the other end of the plug main body 11. A number of annular projections 15 are formed on the outer surface at the other end of the plug main body 11 to increase a contact area between the plug main body 11 and the outside cover 30 to be described later and thus prevent separation from each other.

A pin member 18 which can be press-fitted to a socket member 49 of a corresponding socket terminal 48 to be described later is provided at one end of each pin terminal 17. Leads (not shown) of the electric cable 31 are electrically connected to the other end of the pin terminals 17.

The connection sleeve 20 is a cylindrical component so formed as to rotatably engage with the plug main body 11. A guide member 21 is provided on the outer surface at one end of the connection sleeve 20, and a female screw 22 is formed at the other end thereof. A skirt 23 which extends from the opening edge at the other end of the connection sleeve 20 has a pair of notches 24.

The connection ring 25 is a cylindrical component so formed as to engage with the skirt 23 of the connection sleeve 20. The connection ring 25 has a pair of circular-arc slits 26. A pair of projections 27 which engage with the notches 24 of the connection sleeve 20 are formed on the inner surface of the connection ring 25. A guiding concave 26*a* (shown in FIG. 1C) which communicates with one end of each circular-arc slit 26 is also provided on the inner surface of the connection ring 25.

The outside cover 30 is integrally formed from resin so as to connect the plug main body 11 with the electric cable 31 as one piece.

The electric cable 31 has a plurality of leads (not shown) which are covered with resin. The respective leads are soldered or contact-bonded to the other ends of the pin terminals 17 to provide electric connection therebetween.

In the plug 10 having the components described above, the respective pin members 18 project from the bottom of the engagement concave 12 of the plug main body 11 by electrically connecting the respective leads of the electric cable 31 to the other ends of the pin terminals 17 and then press-fitting the respective pin terminals 17 to the corresponding terminal holes 16 of the plug main body 11 as illustrated in FIG. 9. Thereafter, by fitting the connection sleeve 20 to the plug main body 11 and then fitting the connection ring 25 to the connection sleeve 20, the connection sleeve 20 and the connection ring 25 are allowed to be rotated as one piece. Also, the connection sleeve 20 contacts the annular rib 13 of the plug main body 11 to prevent separation from each other. Subsequently, the outside cover 30 is formed to close the connection between the plug main body 11 and the electric cable 31 with resin, thereby completing assembly of the plug 10.

Figure 10A:
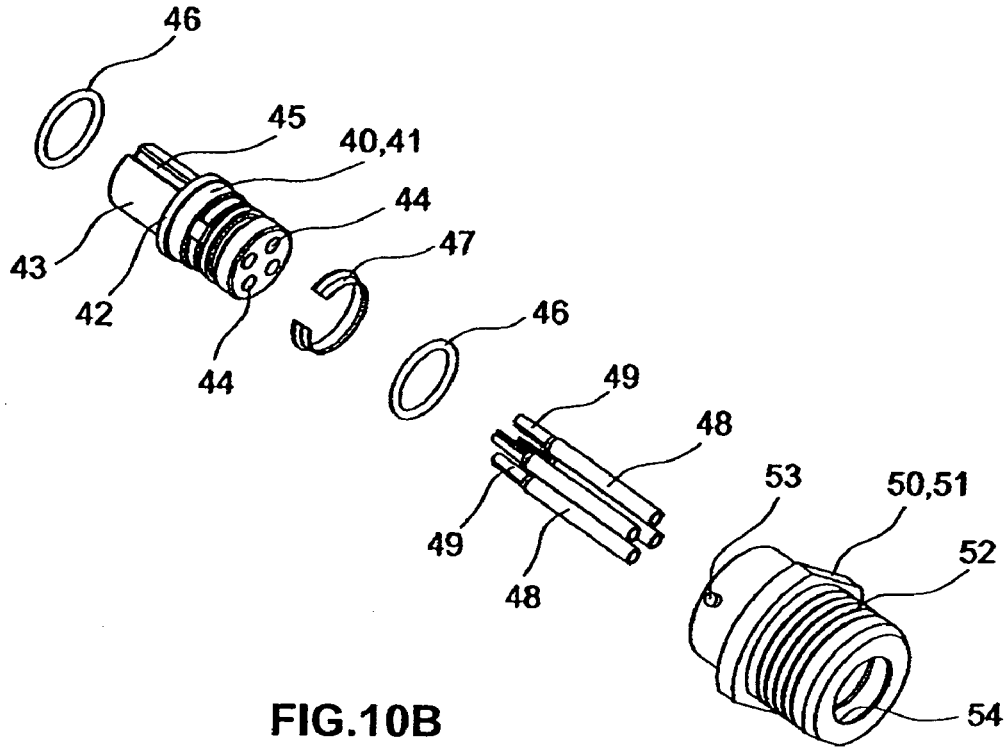
FIGS. 10A and 10B are perspective views of a disassembled bayonet socket in the first embodiment as viewed at different angles.

As illustrated in FIGS. 1, 2 and 10, the socket 40 has a socket main body 41, socket terminals 48, two sealing O-rings 46 attached to the socket main body 41, a C-shaped stopper, and a connection socket 50.

The socket main body 41 is a cylindrical component made from resin, and an annular rib 42 for preventing separation is provided on the outer surface at almost the center of the socket main body 41. An insertion member 43 is provided at one end of the socket main body 41, and four terminal holes 44 are formed within the socket main body 41 to communicate with both ends thereof. A guide groove 45 is formed on the outer surface of the insertion member 43 in the direction of the axial center.

The C-shaped stopper 47 engages with the outer surface of the socket main body 41 to prevent separation thereof.

Leads of a not-shown electric cable are soldered or contact-bonded to one end of each socket terminal 48 to provide electric connection therebetween, and the socket member 49 to which the pin member 18 of the corresponding pin terminal 17 can be press-fitted is provided at the other end of each socket terminal 48.

Figure 10B:
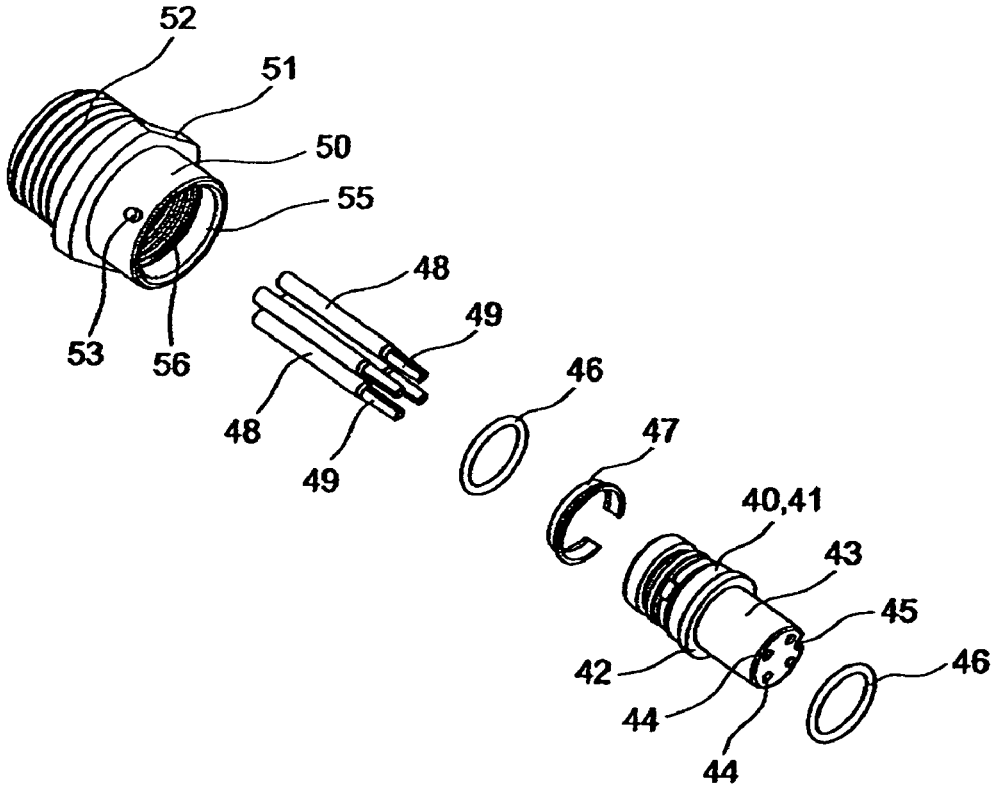

The socket holder (connection socket) 50 is a cylindrical component capable of accommodating the socket main body 41. A fastening rib 51 is provided on the outer surface at almost the center of the socket holder 50. A fixing male screw 52 is formed at one end of the socket holder 50, and a pair of engaging projections 53 are disposed on the same straight line at the other end of the socket holder 50. Additionally, an annular rib 54 for preventing separation of the socket main body 41 is provided on the opening edge at one end of the socket holder 50. A guide surface 55 is positioned on the inner surface at the other end of the socket holder 50 close to the opening edge thereof, and a female screw 56 is formed at the back of the guide surface 55 (FIG. 10B).

In this structure, the O-rings 46 and the stopper 47 are attached to the socket main body 41. The socket terminals 48 to which the leads of the electric cable are connected are each press-fitted to the terminal holes 44 of the socket main body 49, and then the socket main body 41 is press-fitted to the socket holder 50. In this condition, the stopper 47 engages with the inner surface of the socket holder 50 to prevent separation of the socket main body 41.

For connecting the bayonet plug 10 and the bayonet socket 40 having the above-described structures, the guiding groove 45 formed on the insertion member 43 of the socket main body 41 is fitted to the guiding projection 14 provided on the engagement concave 12 of the plug main body 11 and is pressed thereto as illustrated in FIG. 1. Subsequently, each of the engaging projections 53 of the socket holder 50 passes through the guiding concave 26*a* to be fitted to one end of the corresponding circular-arc slit 26. By rotating the connection ring 25, the engaging projection 53 is brought into contact with the other end of the circular-arc slit 26. As a result, the insertion member 43 of the socket main body 41 is pressed into a predetermined position of the engagement concave 12 of the plug main body 11, and the pin members 18 of the pin terminals 17 are press-fitted to the socket members 49 of the socket terminals 48 for making electric connection therebetween. Also, the annular rib 13 of the plug main body 11 press-contacts with the O-ring 46 to secure high water-proofing properties.

Figure 3A:
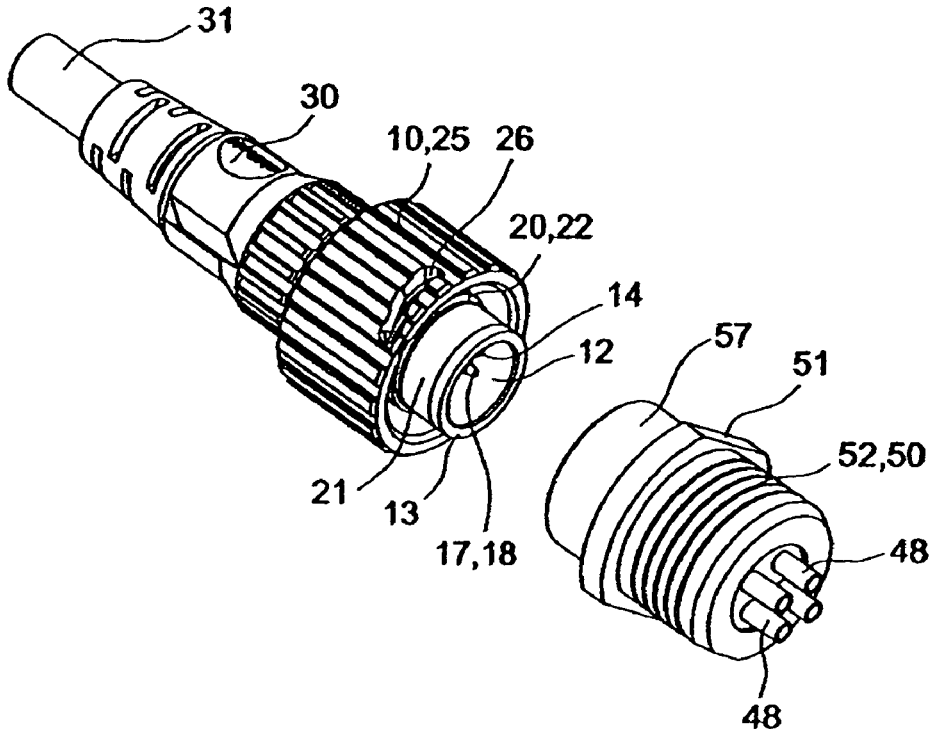
FIGS. 3A and 3B are perspective views of a connector before connection and after connection, respectively, in a second embodiment according to the invention.
Figure 3B:
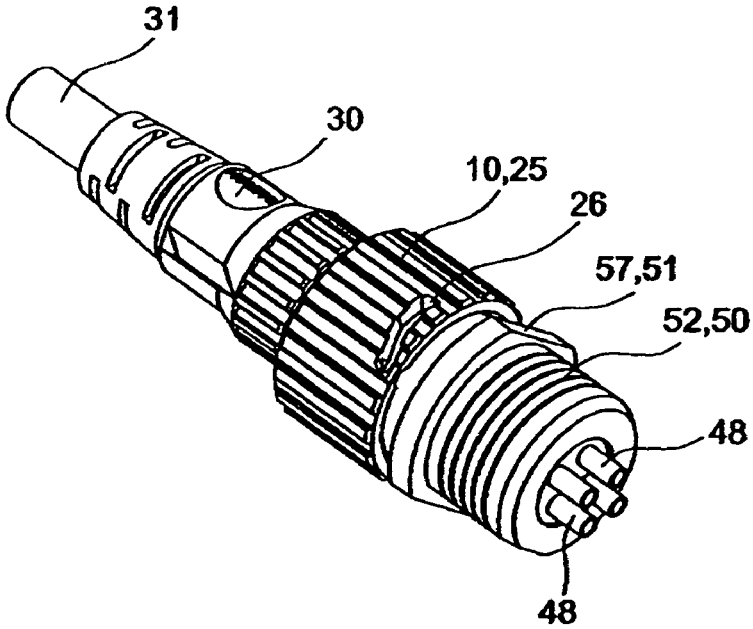
Figure 4A:
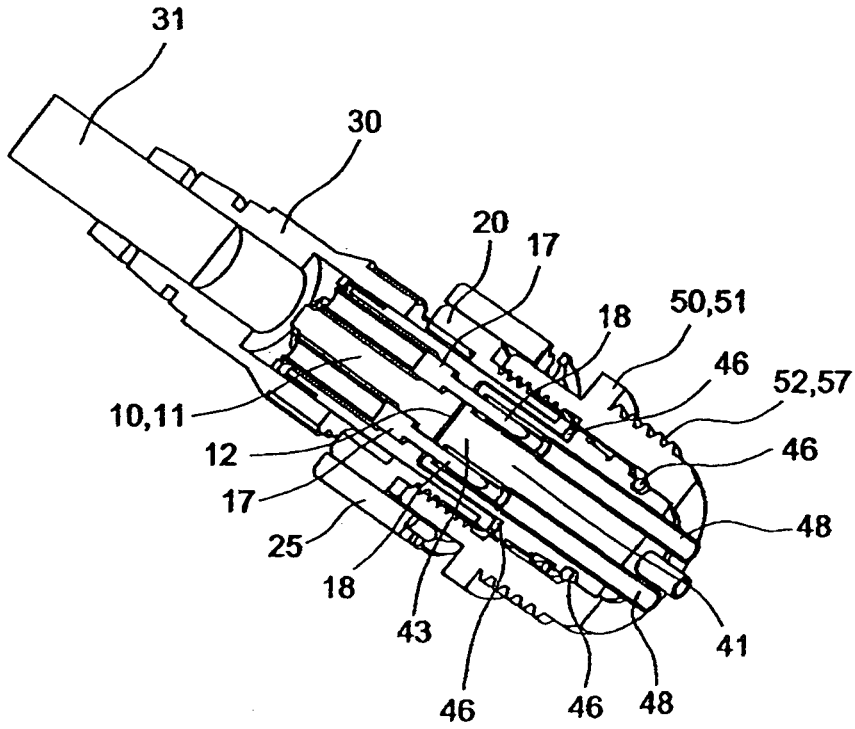
FIGS. 4A and 4B are a cross-sectional view and a cross-sectional front view of FIG. 3B, respectively.
Figure 4B:
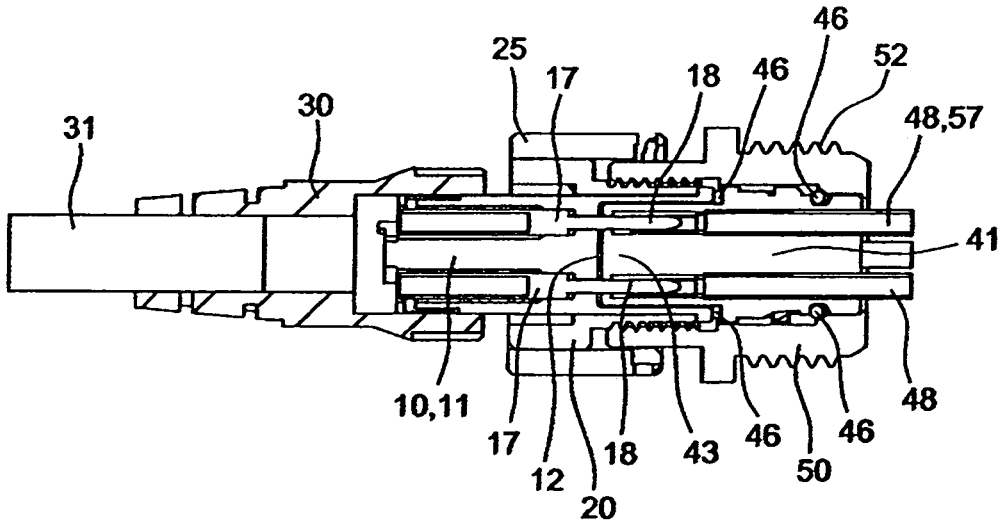

In a second embodiment, the bayonet plug 10 and a screw socket 57 are coupled as illustrated in FIGS. 3 and 4. The bayonet plug 10 in this embodiment is identical to that of the first embodiment. Thus, similar reference numerals are given to similar parts and explanation of those is omitted herein.

Figure 11A:
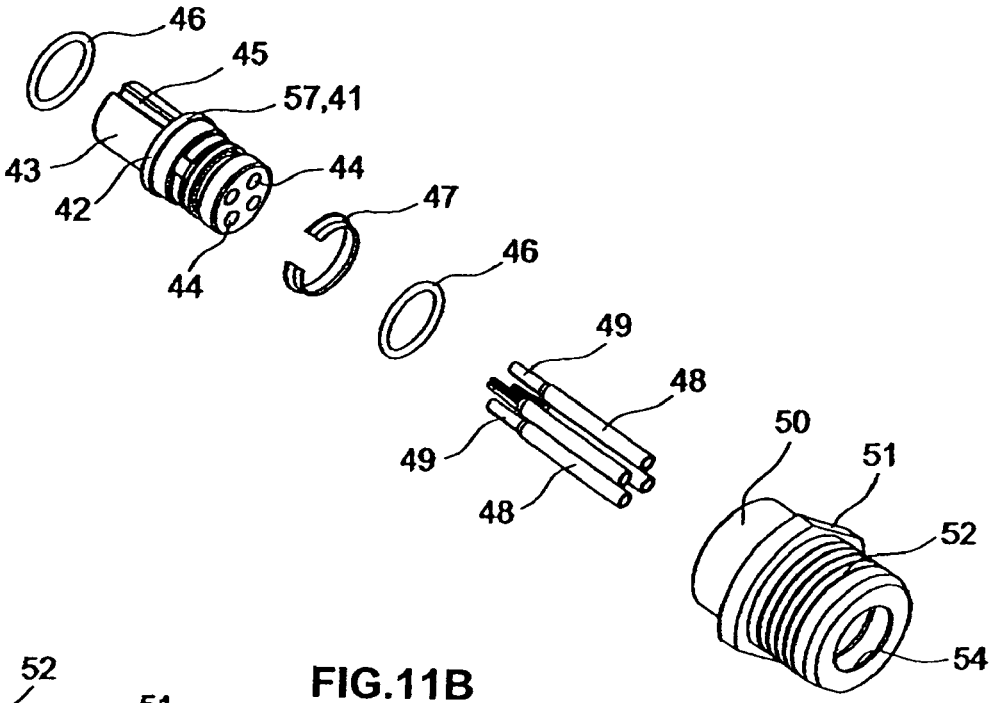
FIGS. 11A and 11B are perspective views of a disassembled screw socket in the second and fourth embodiments as viewed at different angles.
Figure 11B:
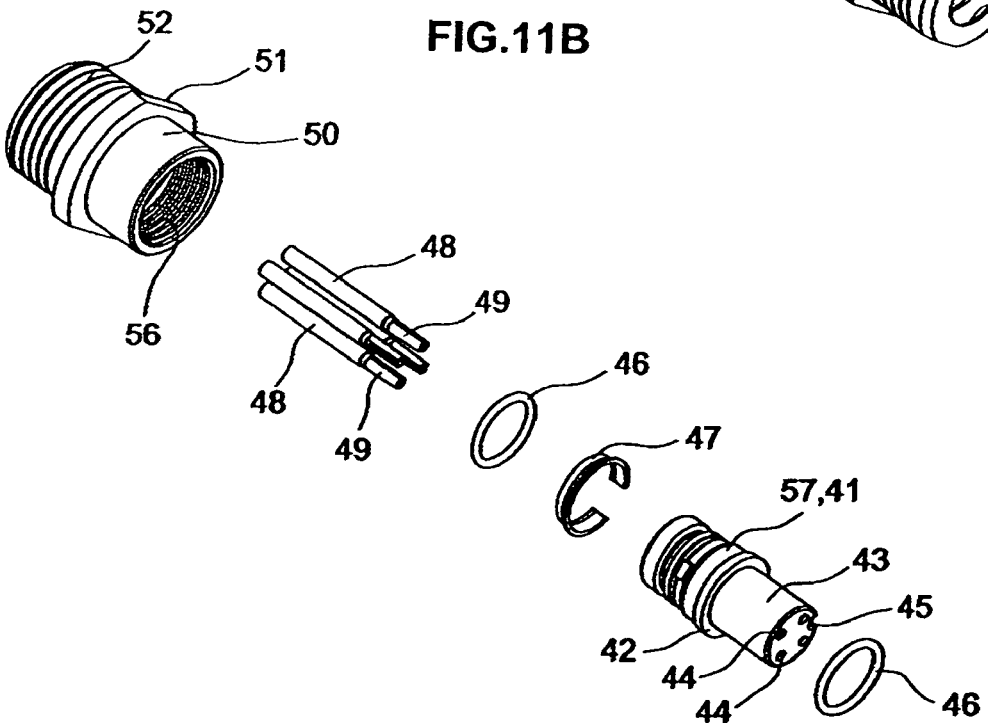

As illustrated in FIG. 11, the screw socket 57 has the same basic structure as that of the bayonet socket 40 of the first embodiment. The differences between the sockets 57 and 40 are that the engaging projections are not provided on the socket holder 50 and that the female screw 56 is formed on the entire inner surface at the other end of the socket holder 50 instead of providing the guide member thereon in this embodiment.

For connecting the bayonet plug 10 and the screw socket 57 having the above structures, the guiding groove 45 provided on the insertion member 43 of the socket main body 41 is fitted to the guiding projection 14 provided on the engagement concave 12 of the plug main body 11 and is pressed thereto as illustrated in FIG. 3. Subsequently, by rotating the connection ring 25 and the connection sleeve 20, the male screw 22 formed on the connection sleeve 20 and the female screw 56 formed on the inner surface of the socket holder 50 are brought into engagement with each other and then are tightened. As a result, the insertion member 43 of the socket main body 41 is pressed into a predetermined position of the engagement concave 12 of the plug main body 11, and the pin members 18 of the pin terminals 17 are press-fitted to the socket members 49 of the socket terminals 48 for making electric connection therebetween. Also, the annular rib 13 of the plug main body 11 press-contacts with the O-ring 46 to secure high water-proofing properties.

Figure 5A:
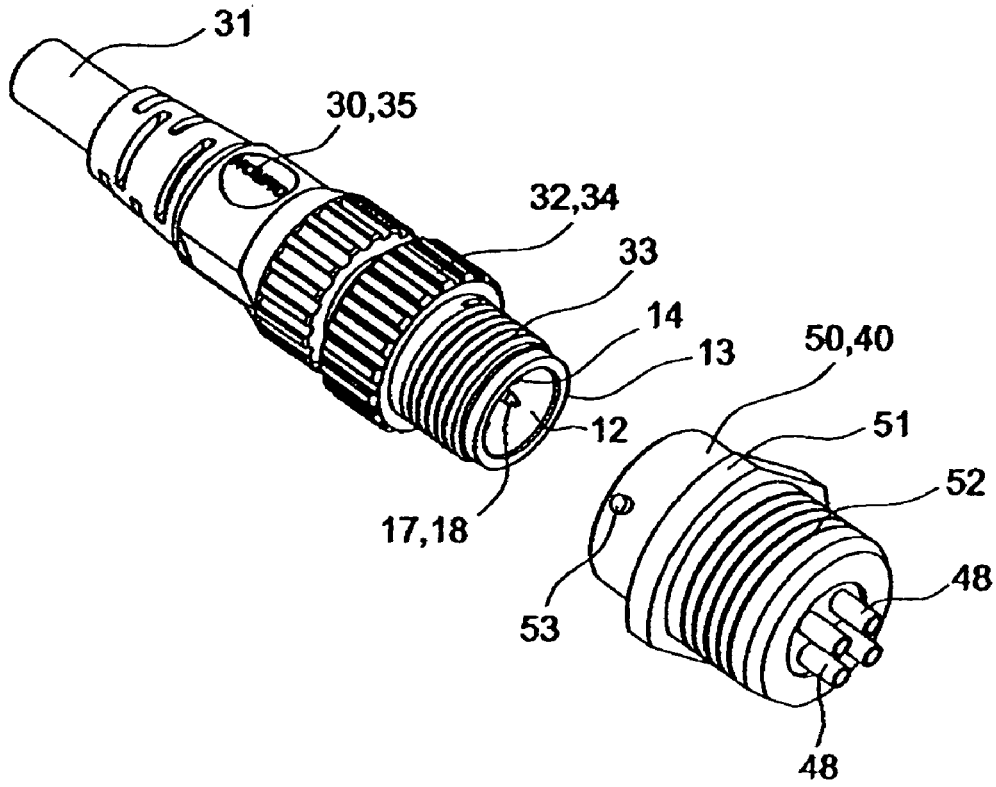
FIGS. 5A and 5B are perspective views of a connector before connection and after connection, respectively, in a third embodiment according to the invention.
Figure 5B:
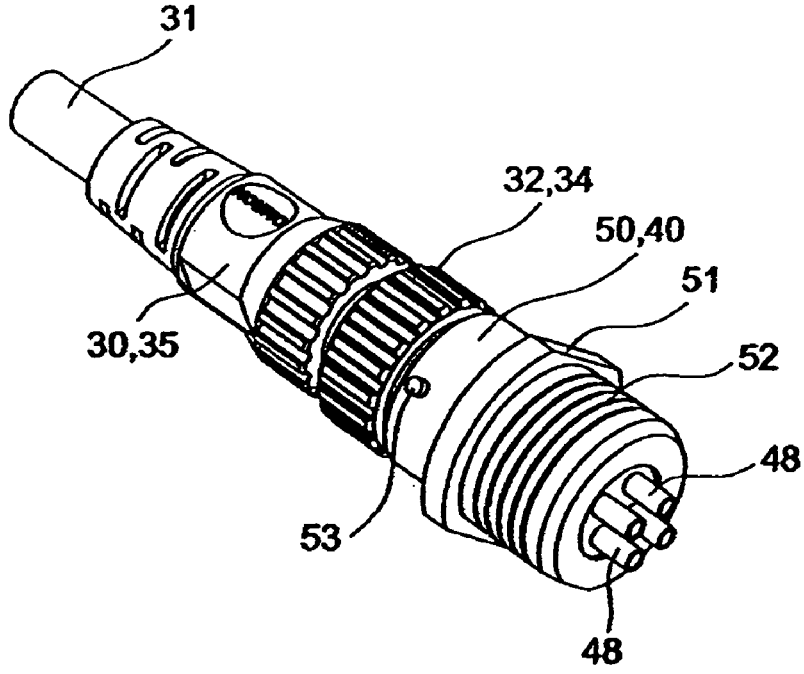
Figure 6A:
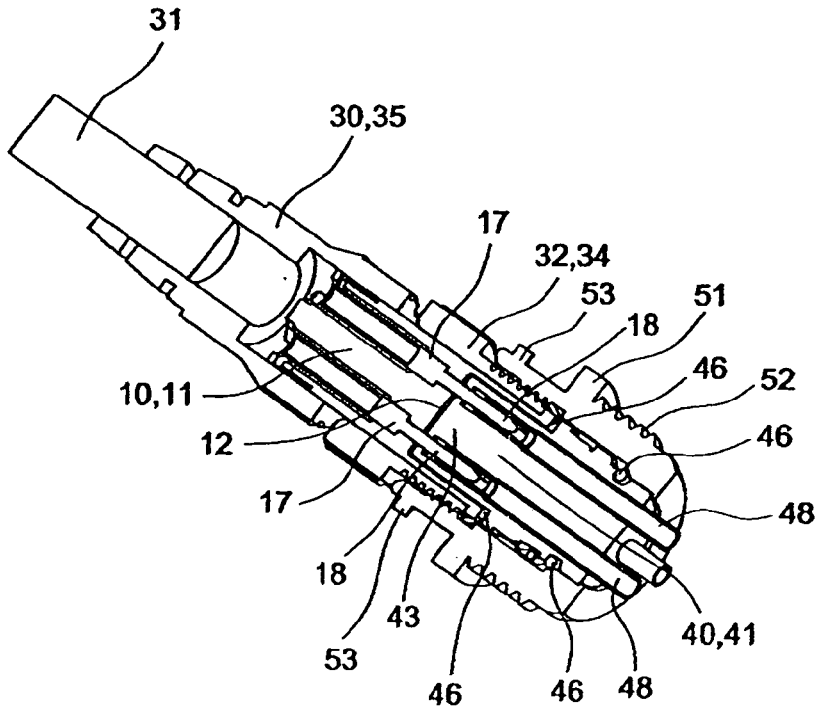
FIGS. 6A and 6B are a cross-sectional view and a cross-sectional front view of FIG. 5B, respectively.
Figure 6B:
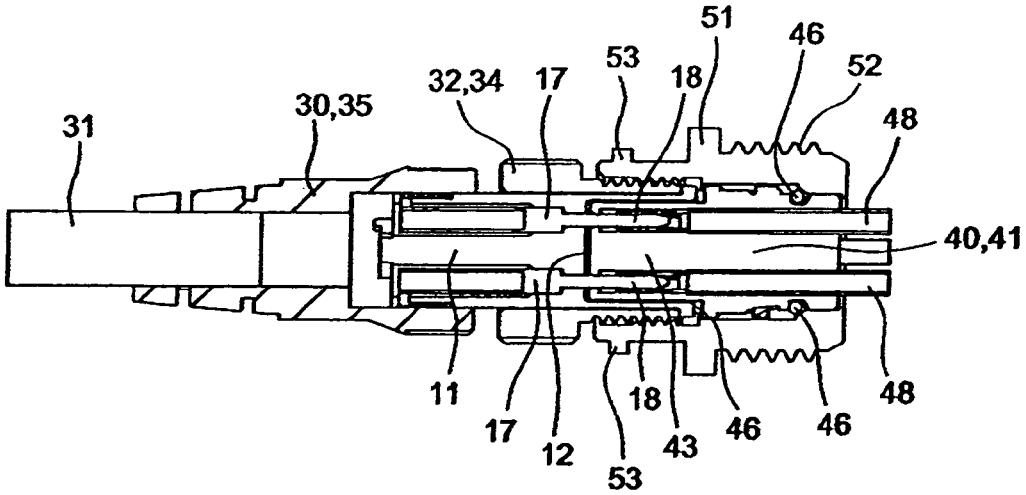

In a third embodiment, a screw plug 35 and the bayonet socket 40 are coupled as illustrated in FIGS. 5 and 6. The bayonet socket 40 in this embodiment is identical to that of the first embodiment. Thus, similar reference numerals are given to similar parts and explanation of those is omitted herein.

Figure 12A:
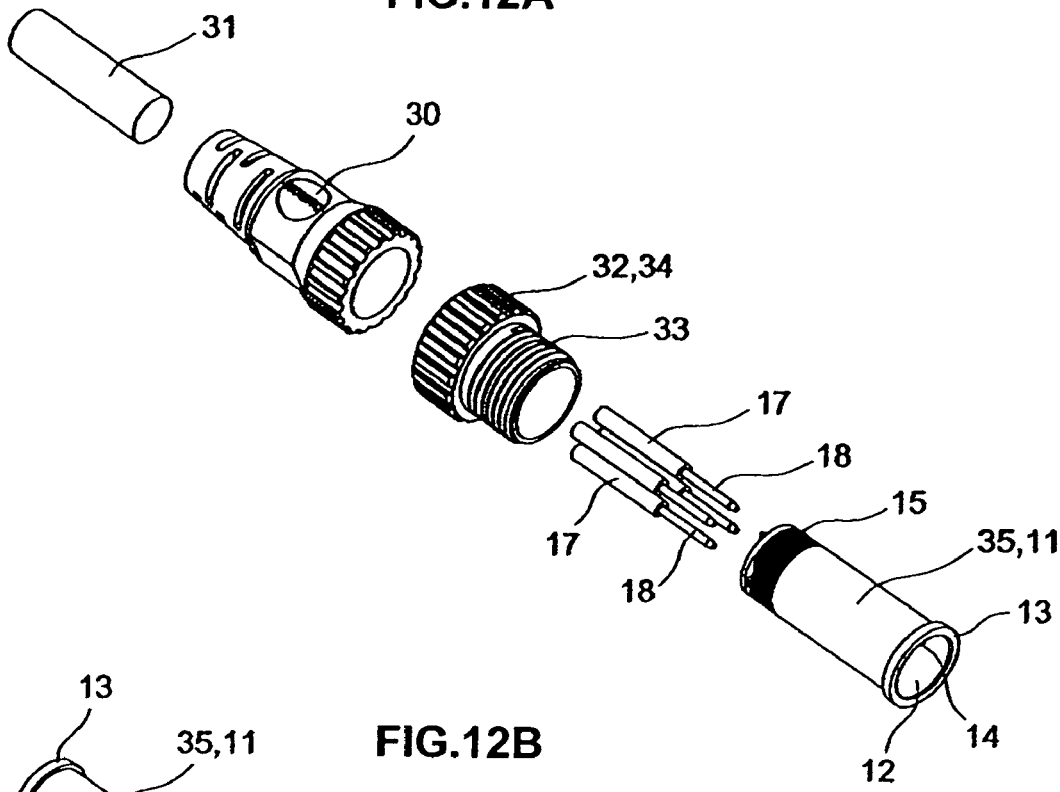
FIGS. 12A and 12B are perspective views of a disassembled screw plug in the third and fourth embodiments as viewed at different angles.
Figure 12B:
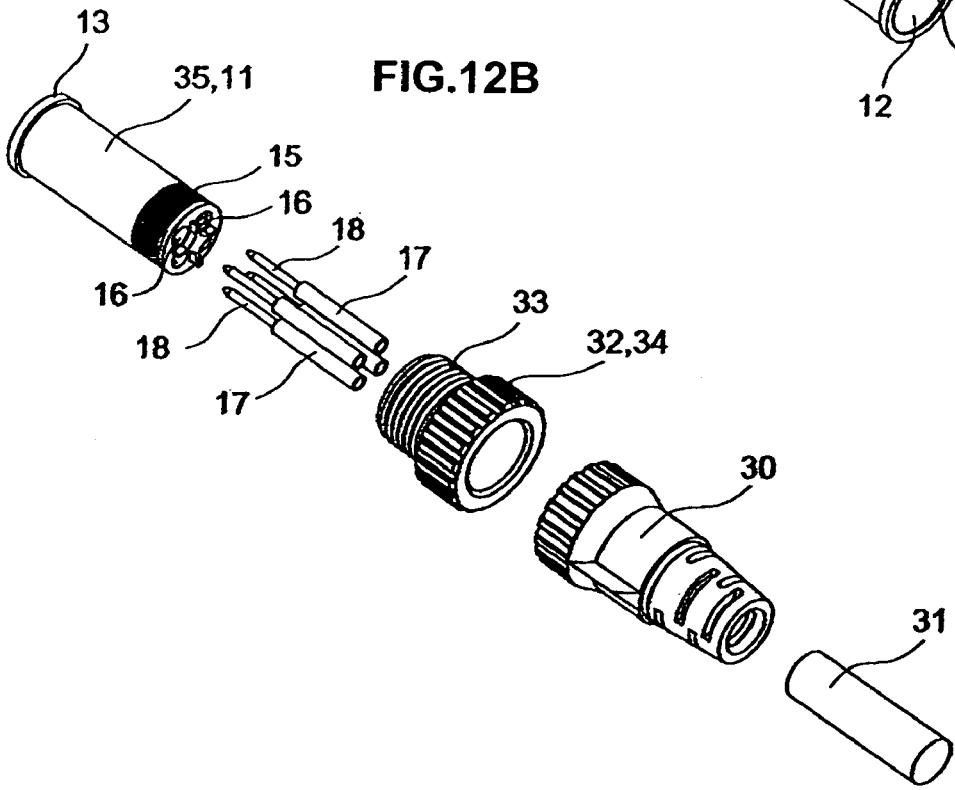

As illustrated in FIG. 12, the screw plug 35 has the same basic structure as that of the bayonet plug 10 of the first embodiment except that a plug holder 32 is provided in lieu of the connection sleeve and the connection ring.

The plug holder 32 is a cylindrical component which rotatably engages with the plug main body 11. A male screw 33 is formed on an almost half of the outer surface at one end of the plug holder 32, and an annular rib 34 provided for rotational operation is formed on an almost half of the outer surface at the other end of the plug holder 32.

For connecting the screw plug 35 and the bayonet socket 40 having the above structures, the guiding groove 45 provided on the insertion member 43 of the socket main body 41 is fitted to the guiding projection 14 provided on the engagement concave 12 of the plug main body 11 and is pressed thereto as illustrated in FIG. 5. Subsequently, by rotating the plug holder 32, the male screw 33 formed on the plug holder 32 and the female screw 56 formed on the inner surface of the socket holder 50 are brought into engagement with each other and then are tightened. As a result, the insertion member 43 of the socket main body 41 is pressed into a predetermined position of the engagement concave 12 of the plug main body 11, and the pin members 18 of the pin terminals 17 are press-fitted to the socket members 49 of the socket terminals 48 for making electric connection therebetween. Also, the annular rib 13 of the plug main body 11 press-contacts with the O-ring 46 to secure high water-proofing properties.

Figure 7A:
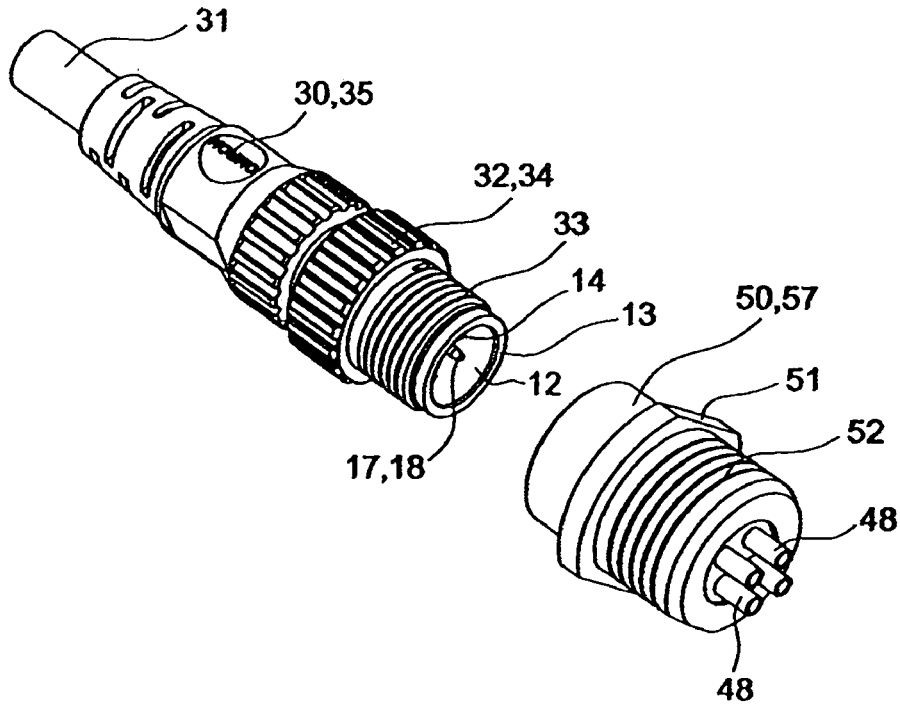
FIGS. 7A and 7B are perspective views of a connector before connection and after connection, respectively, in a fourth embodiment according to the invention.
Figure 7B:
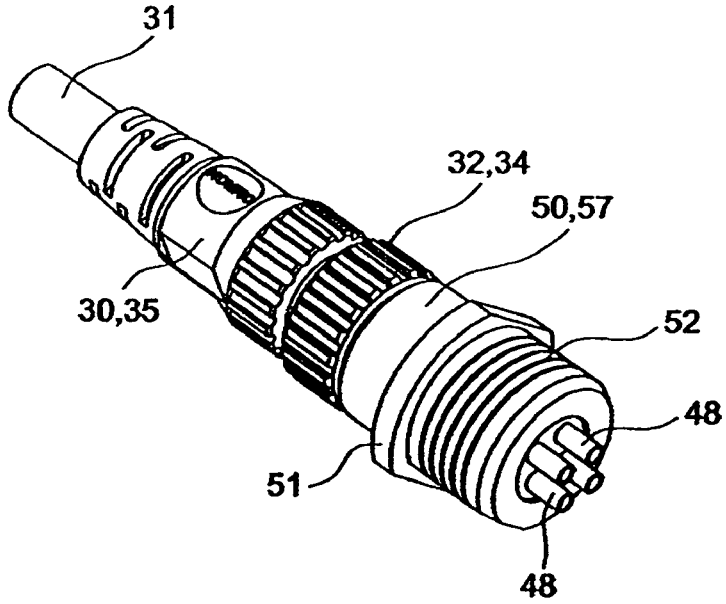
Figure 8A:
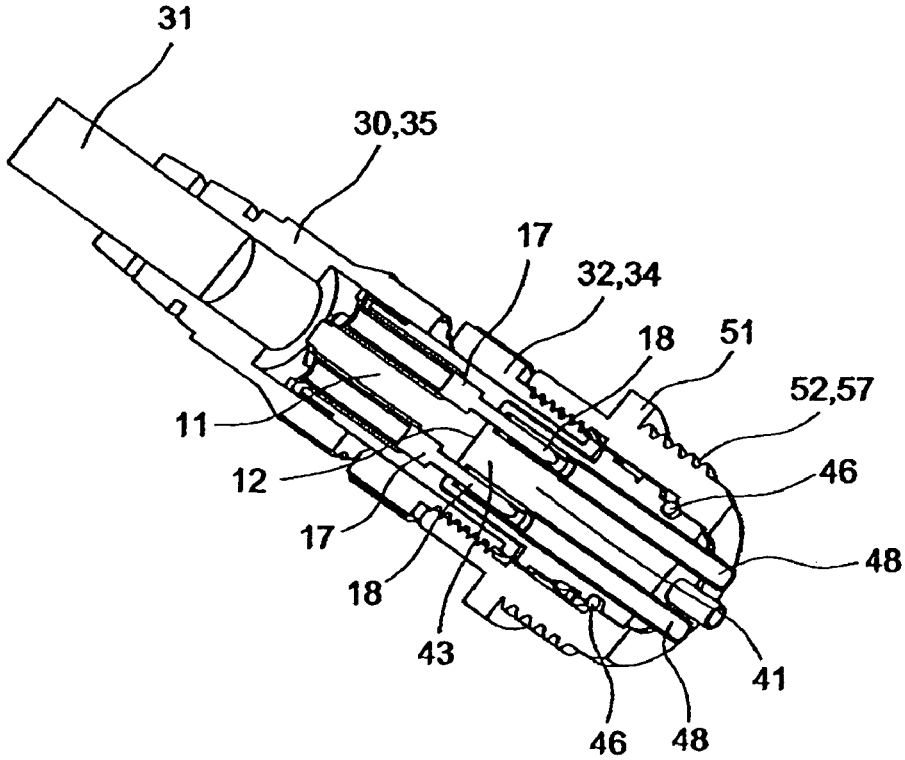
FIGS. 8A and 8B are a cross-sectional view and a cross-sectional front view of FIG. 7B, respectively.
Figure 8B:
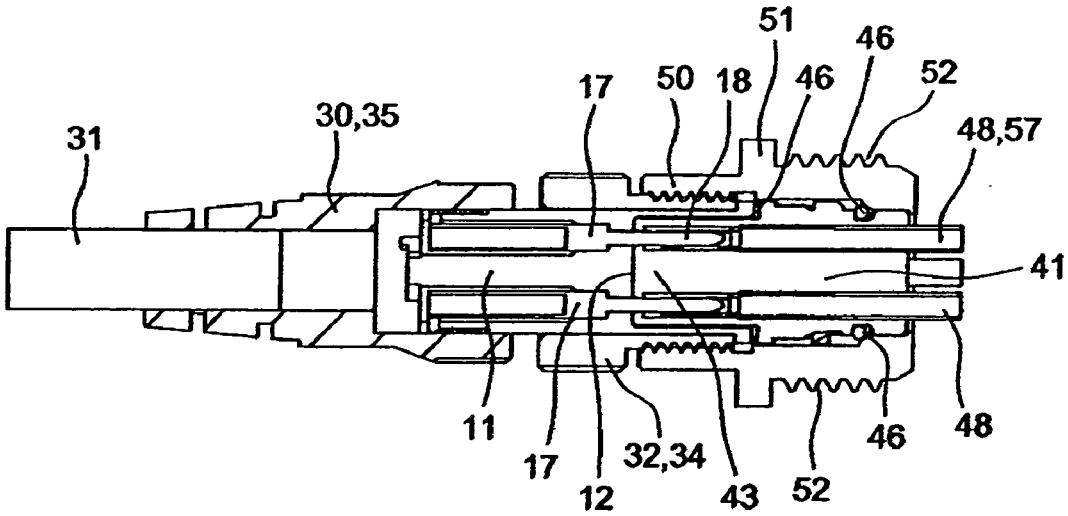

In a fourth embodiment, the screw plug 35 shown in the second embodiment and the screw socket 57 shown in the third embodiment are coupled as illustrated in FIGS. 7 and 8. Similar reference numerals are given to similar parts, and explanation of those is omitted herein.

For connecting the screw plug 35 and the screw socket 57, the guiding groove 45 provided on the insertion member 43 of the socket main body 41 is fitted to the guiding projection 14 provided on the engagement concave 12 of the plug main body 11 and is pressed thereto as illustrated in FIG. 7. Subsequently, by rotating the plug holder 32, the male screw 33 formed on the plug holder 32 and the female screw 56 formed on the inner surface of the socket holder 50 are brought into engagement with each other and then are tightened. As a result, the insertion member 43 of the socket main body 41 is pressed into a predetermined position of the engagement concave 12 of the plug main body 11, and the pin members 18 of the pin terminals 17 are press-fitted to the socket members 49 of the socket terminals 48 for making electric connection therebetween. Also, the annular rib 13 of the plug main body 11 press-contacts with the O-ring 46 to secure high water-proofing properties.

While the electric cable is coaxially connected via the plug to the socket which has been fixed to an attachment plate in advance in the above-described embodiments, a pair of electric cables may be directly and coaxially connected to make electric connection therebetween without using the attachment plate. For example, socket holders of both the bayonet socket and the screw socket are formed to have a cylindrical shape capable of rotatably accommodating the socket main body, and an annular rib for preventing separation of the socket main body is provided at the opening edge of one end of the socket holder. Also, a guide surface is provided on the inner surface at the other end of the socket holder close to the opening edge thereof, and a female screw is formed at the back of the guide surface. After the socket holder is assembled to the socket main body, an outside cover for closing the connection between the socket holder and the electric cable by resin is formed so as to prevent separation of the socket holder. In attaching the socket holder to the socket main body, it is preferable to provide slight clearance from the socket main body in the direction of the axial center.

The connector according to the invention can be employed not only for making electric connection described above, but also is applicable to a case when pipes through which gas and liquid flow are coaxially connected.

What is claimed is:

1. A connector for coaxially connecting connection lines by connecting a plug one end of which connects with one of the connection lines and a socket one end of which connects with the other of the connection lines as one piece, wherein:

the plug includes (a) a plug main body one end of which connects with the connection line and the other end of which has an engagement concave, (b) a connection sleeve as a cylindrical component rotatably attached to the outer surface of the plug main body with separation prevented, a guide member being provided on the outer surface at one end of the connection sleeve, and a male screw being formed on the outer surface at the other end of the connection sleeve, and (c) a connection ring as a cylindrical component on the outer surface of which a circular-arc slit is formed, the connection ring coaxially accommodating the connection sleeve with separation prevented, and the connection ring being assembled to the connection sleeve to be rotatable with the connection sleeve as one piece;

the socket includes (a) a socket main body one end of which connects with the connection line and the other end of which has a projecting insertion member, and (b) a socket holder as a cylindrical component which coaxially accommodates the socket main body with separation prevented, an engaging projection being provided on the outer surface of the socket holder close to the opening edge thereof, a guide member being provided on the inner surface of the socket holder opposed to the socket main body close to the opening edge of the socket holder, and a female screw being formed at the back of the guide member; and the insertion member of the socket main body is fitted to the engagement concave of the plug main body, the engaging projection of the socket holder is fitted to one end of the circular-arc slit of the connection ring, and the engaging projection is relatively shifted along the circular-arc slit to be positioned and locked at the other end of the circular-arc slit.

2. A connector as set forth in claim 1, wherein the connection lines are electric cables.

3. A connector as set forth in claim 1, wherein the socket holder is rotatably attached to the socket main body.

4. A connector as set forth in claim 3, wherein the connection lines are electric cables.

5. A connector as set forth in claim 1, wherein:

a screw socket included in the connector has a socket holder as a cylindrical component which coaxially accommodates a socket main body with separation prevented and on the inner surface of which a female screw is formed opposed to the socket main body;

an insertion member of the socket main body is fitted to the engaging concave of the plug main body; and the female screw of the screw socket is fitted to the male screw of the connection sleeve so as to connect the screw socket to the plug as one piece.

6. A connector as set forth in claim 5, wherein the connection lines are electric cables.

7. A connector as set forth in claim 1, wherein:

a screw plug included in the connector has a plug holder as a cylindrical component which is rotatably attached to the outer surface of a plug main body with separation prevented and on the outer surface of which a male screw is formed at the tip of the plug holder;

the insertion member of the socket main body is fitted to an engagement concave of the plug main body; and the male screw of the screw plug is fitted to the female screw of the socket holder so as to connect the screw plug to the socket as one piece.

8. A connector as set forth in claim 7, wherein the connection lines are electric cables.

9. A connector as set forth in claim 3, wherein:

a screw plug included in the connector has a plug holder as a cylindrical component which is rotatably attached to the outer surface of a plug main body with separation prevented and on the outer surface of which a male screw is formed at the tip of the plug holder;

the insertion member of the socket main body is fitted to an engagement concave of the plug main body; and the male screw of the screw plug is fitted to the female screw of the socket holder so as to connect the screw plug to the socket as one piece.

10. A connector as set forth in claim 9, wherein the connection lines are electric cables.

* * * * *